US006863180B2

(12) United States Patent
Apps et al.

(10) Patent No.: US 6,863,180 B2
(45) Date of Patent: Mar. 8, 2005

(54) COLLAPSIBLE CONTAINER

(75) Inventors: William P. Apps, Alpharetta, GA (US); Robert V. Gruber, Dallas, TX (US)

(73) Assignee: Rehrig Pacific Company, Los Angeles, CA (US)

( * ) Notice: Subject to any disclaimer, the term of this patent is extended or adjusted under 35 U.S.C. 154(b) by 131 days.

(21) Appl. No.: 10/077,543

(22) Filed: Feb. 15, 2002

(65) Prior Publication Data

US 2003/0155275 A1 Aug. 21, 2003

(51) Int. Cl.[7] ..... B65D 19/00

(52) U.S. Cl. ..... 206/600; 206/577; 220/6; 220/1.5

(58) Field of Search ..... 206/600, 503, 206/505, 517, 577; 220/6, 7, 1.5

(56) References Cited

U.S. PATENT DOCUMENTS

| | | | | |
|---|---|---|---|---|
| 3,970,209 A | | 7/1976 | Baxter | |
| 4,081,099 A | | 3/1978 | Shead | |
| 4,163,495 A | | 8/1979 | Drader | |
| 4,186,841 A | | 2/1980 | Buckley et al. | |
| 4,674,647 A | * | 6/1987 | Gyenge et al. | 220/6 |
| 4,735,330 A | | 4/1988 | Hoss | |
| 4,735,331 A | | 4/1988 | Keenan et al. | |
| 5,076,457 A | * | 12/1991 | Marovskis | 220/6 |
| 5,398,834 A | | 3/1995 | Umiker | |
| 5,398,835 A | | 3/1995 | Blinstrub | |

(List continued on next page.)

FOREIGN PATENT DOCUMENTS

| | | |
|---|---|---|
| DE | 27 34 964 | 2/1979 |
| DE | 91 03 975.4 | 4/1991 |
| EP | 0 073 357 A2 | 3/1983 |
| EP | 0 385 914 A1 | 9/1990 |
| EP | 0 404 041 A1 | 12/1990 |
| EP | 0 602 575 A2 | 12/1993 |
| EP | 0 705 764 A2 | 8/1995 |
| EP | 0 690 003 | 1/1996 |
| EP | 0 785 139 A1 | 11/1996 |
| EP | 0 785 142 | 7/1997 |
| EP | 0 962 394 A1 | 12/1999 |
| EP | 0 962 396 | 12/1999 |
| EP | 1 114 779 A2 | 7/2001 |
| EP | 1 182 139 A2 | 7/2001 |
| WO | WO 97/26190 | 1/1997 |
| WO | WO 97/26193 | 1/1997 |
| WO | WO 97/49613 | 12/1997 |
| WO | WO 02/034630 | 5/2002 |

*Primary Examiner*—Jila M. Mohandesi

(57) ABSTRACT

A collapsible container includes a base member having a pair of first base edges, and a pair of second base edges having a recessed base area formed therein. A pair of first opposed walls pivotably attached to the first base edges and orientable between an upright an upright orientation and an inwardly folded orientation. A pair of second opposed walls pivotably attached to the second base edges and orientable between an upright orientation and an overlapping folded orientation. Each of the second opposed walls generally corresponding in height and having a projection member arranged to be received within the recessed area of the second base edges when in the overlapping folded orientation, and each side wall has a recessed wall area arranged to receive the projection member of the second opposed wall folded thereon.

19 Claims, 10 Drawing Sheets

U.S. PATENT DOCUMENTS 5,467,885 A 11/1995 Blinstrub
5,474,197 A 12/1995 Hillis et al.
5,515,987 A 5/1996 Jacques et al.
5,538,153 A 7/1996 Marovskis et al.
5,746,342 A 5/1998 Jacques et al.
5,788,103 A * 8/1998 Wagner et al. ..... 220/6
5,829,617 A 11/1998 Umiker
5,853,099 A 12/1998 Lessard
5,938,059 A 8/1999 Luburic
5,975,324 A 11/1999 Schmitt
5,988,420 A 11/1999 Jacques et al.
6,015,056 A 1/2000 Overholt et al.
6,073,790 A 6/2000 Umiker
6,098,827 A 8/2000 Overholt et al.
6,189,695 B1 2/2001 Ching-rong
6,286,701 B1 9/2001 Umiker
6,290,081 B1 9/2001 Merey
6,293,418 B1 9/2001 Ogden et al.
6,398,054 B1 6/2002 Overholt et al.
6,405,888 B1 6/2002 Overholt et al.
6,409,041 B1 6/2002 Overholt et al.
6,460,717 B1 10/2002 Smyers
6,631,822 B1 10/2003 Overholt
2002/0108950 A1 8/2002 Moorman et al.
2003/0116564 A1 6/2003 Overholt et al.
2003/0132228 A1 7/2003 Apps et al.

* cited by examiner

COLLAPSIBLE CONTAINER

BACKGROUND OF THE INVENTION

1. Field of the Invention

This invention relates to a collapsible container having at least one pair of opposed overlapping side walls.

2. Background Art

Some collapsible containers have walls which may be inwardly folded in order to stack the containers in an efficient and space-conserving manner when not in use. This efficient means of storage is most easily achieved when the container has walls which do not overlap. However, many collapsible containers have relatively tall walls which when assembled in their upright orientation, provide a large container volume and depth. Accordingly, when folded, at least one of the pairs of opposed walls will overlap. Unfortunately, the overlapping wall typically results in less efficient stacking of the collapsed containers, because the second overlapping wall will be forced to sit high upon the first overlapping wall. Accordingly, the package height and the resulting stacking height of the collapsed unit will be relatively high.

Containers that attempt to resolve the overlapping issue have been restricted, often requiring that the walls be folded in a particular sequence, or by having an unsymmetrical design or walls of varied heights. Further, present collapsible containers may not provide the desired level of airflow among adjacent containers.

Accordingly, a collapsible container is desired which is able to accommodate overlapping opposed walls such that they are able to be collapsed and stacked efficiently and comparable or better than those containers not having overlapping opposed walls. It would also be desired for the container to have enhanced airflow among like containers.

SUMMARY OF THE INVENTION

It is an object according to the present invention to provide a collapsible container which provides for the walls to be collapsed in an efficient manner and a relatively low package height for purposes of stacking and storing.

It is another object according to the present invention to provide a collapsible container having at least one pair of opposed overlapping side walls which are able to be folded in an efficient manner to provide a relatively low package height.

It is yet another object according to the present invention to provide a container having overlapping side walls which may be folded down in a non-sequential manner.

It is another object to provide a container with a repeating pattern of openings for promoting air flow among adjacent containers in various cross-stacked orientations.

In accordance with these objects, provided is a collapsible container having a base member having bottom wall, a pair of first base wall portions and a pair of second base wall portions, the second base wall portions having a recessed base area formed therein. Also provided is a pair of first opposed walls pivotably attached to a corresponding one of the first base wall portions and orientable between an upright an upright orientation and an inwardly folded orientation. Further included is a pair of second opposed walls pivotably attached to a corresponding one of the second base wall portions and orientable between an upright orientation and an overlapping folded orientation, each of the second opposed walls generally corresponding in height and each having at least one projection member arranged to be received within the recessed area of the second base wall portions when in the overlapping folded orientation, and wherein each second opposed wall has a recessed wall area arranged to receive the projection member of an other second opposed wall folded thereon.

The pair of second opposed walls are preferably oriented parallel to each other when in the inwardly folded position. Further, each of the pair of second opposed walls has a pivot axis of corresponding height from the base member. Further, each of the second opposed walls has a pivot axis disposed in a plane which is oriented generally parallel to the base member.

Also provided herein is a collapsible container including a base having a pair of base side wall edges and a pair of base end wall edges, the base end wall edges having a recess formed therein. Further, provided is a pair of opposed end walls pivotably attached to respective end wall edges and orientable between an upstanding orientation and an inwardly collapsed orientation. Also provided is a pair of opposed side walls pivotably attached to respective side wall edges along hinge axes having a corresponding height from the base, the pair of opposed side walls orientable between an upstanding position and an overlapping folded position. Each side wall has a lateral edge with an upper projecting flange and a recessed area, wherein the side walls may be inwardly foldable in a non-sequential order such that the flange of a first one of the side walls when folded is arranged to be received within the recess of the base end wall edge, while the flange of a second one of the side walls when folded is received within the recessed area of the first one of the side walls, and wherein the side walls are oriented parallel to each other when in the overlapping folded position.

Preferably, the pair of opposed side walls are oriented parallel to each other when in the inwardly folded position. Also, the side walls are generally corresponding in height. Also, each of the side walls has a pivot axis disposed in a plane which is oriented generally parallel to the base.

Further provided is a collapsible container having a base member with a bottom wall, a pair of first opposed edges and a pair of second opposed edges. Also provided is a pair of first opposed walls pivotably connected to the pair of first opposed edges, and orientable between an upright orientation and an inwardly collapsed orientation. Provided also is a pair of second opposed walls each pivotably connected to the pair of second opposed edges along corresponding axes of rotation, wherein when oriented in an inwardly collapsed position, the second opposed walls overlap with each other in a parallel orientation, and the corresponding axes of rotation are disposed in a plane generally parallel to the bottom wall of the base member.

The above objects and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT(S)

Figure 1:
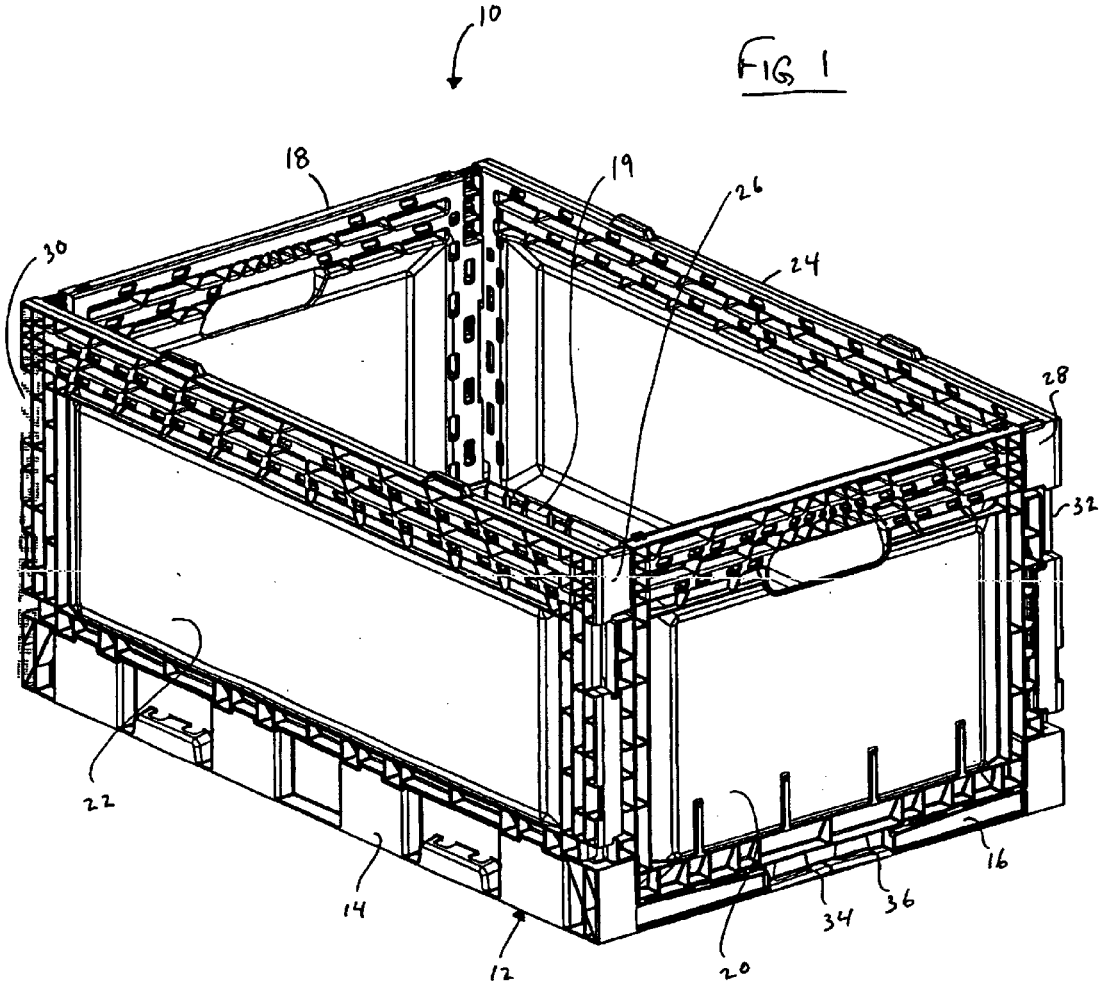
FIG. 1 illustrates a container according to the present invention showing the side walls in an upright and assembled orientation, wherein one pair of opposed side walls, when folded, result in a overlapping orientation.
Figure 2:
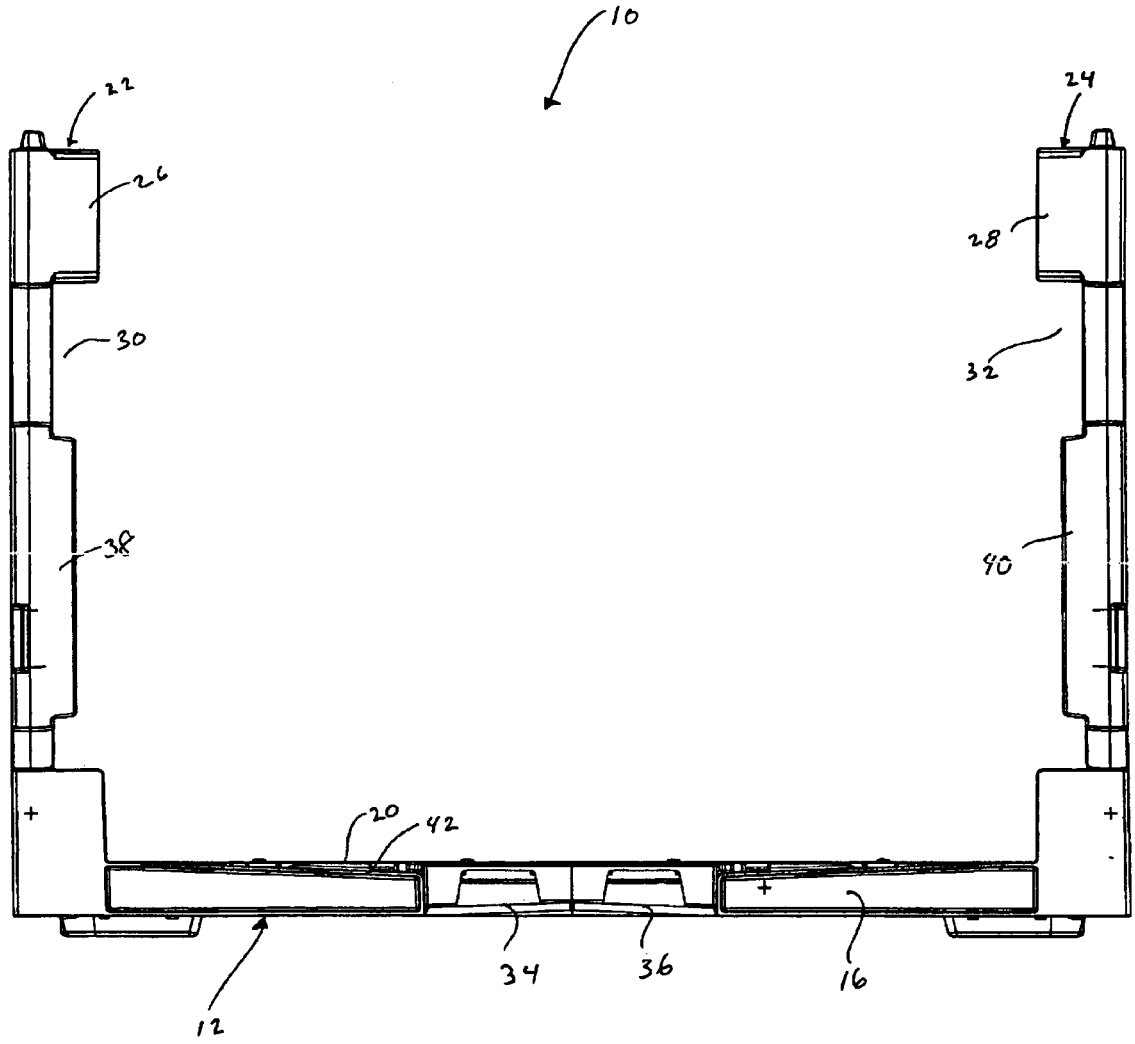
FIG. 2 illustrates a side elevational view of the container, wherein the side walls are oriented in an upright position as in FIG. 1, and the non-overlapping end walls are shown in an inwardly collapsed orientation.
Figure 3:
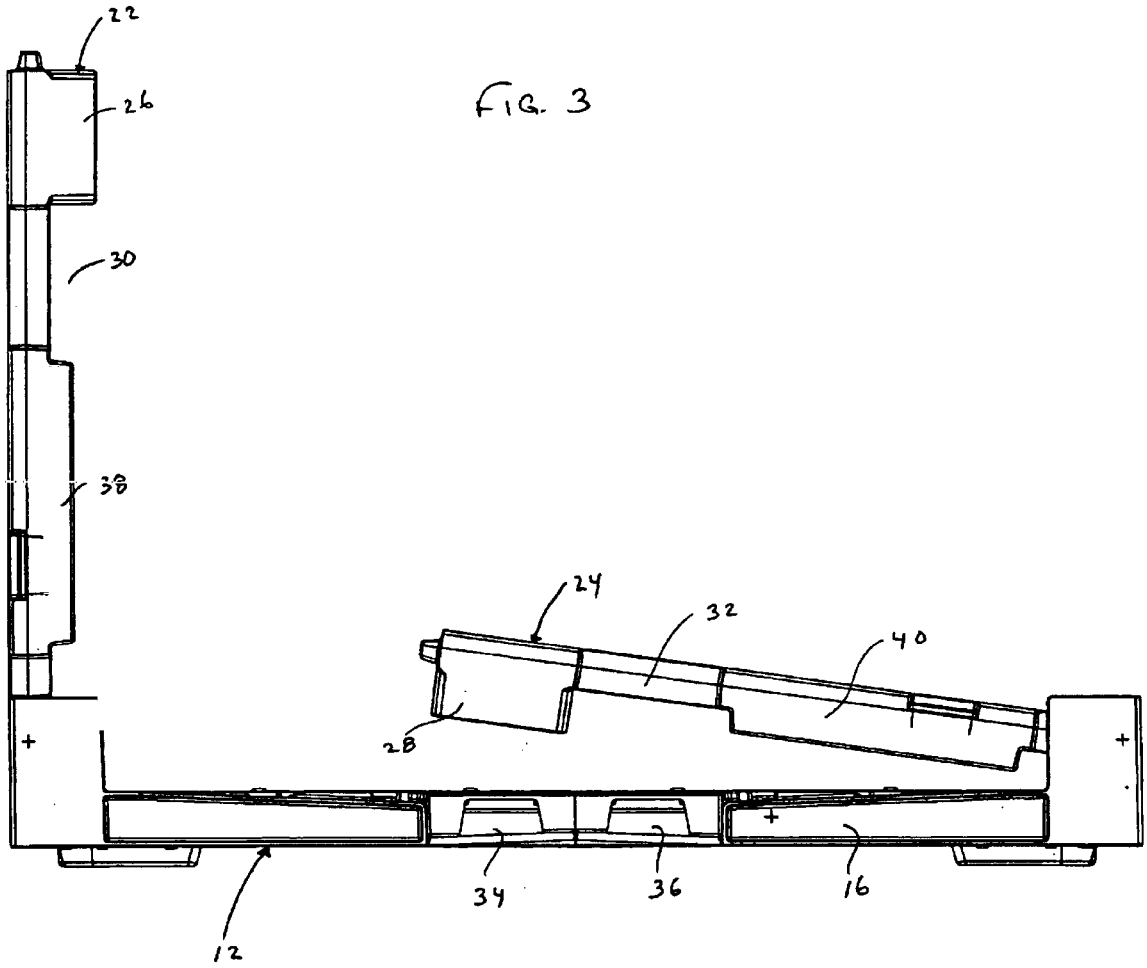
FIG. 3 is similar to the view shown in FIG. 2, but with one of the overlapping side walls rotated partially inward.

FIGS. 1 through 8 illustrate a collapsible container 10 in accordance with the present invention. Container 10 is rectangular in shape and is generally symmetrical about each center line. The components of container 10 are preferably formed by an injection molding process with a polymeric material such as polypropylene, but of course may be formed by any material and process suitable for the application. Container 10 includes a base 12 having a floor portion 13, a pair of first opposed base portions 14 defining first base edges along the sides of container 10, and a pair of second opposed base portions 16 defining second base edges along the ends of container 10.

Container 10 also includes a first pair of opposed walls, generally referred to as end walls 18, 20, each of which is pivotably connected to a corresponding base end portion 16, preferably by way of hinges representatively shown in FIG. 1 as hinge 19. Also included is a second pair of opposed walls, designated as side walls 22, 24, which are pivotably connected to a corresponding base side portion 14, such as via hinges 19. Walls 22, 24 have a corresponding height.

FIGS. 2–6 illustrate the improved overlapping wall feature according to the present invention. For ease of reference and explanation, FIGS. 2–8 illustrate an end elevational view of container 10, in which end walls 18, 20 have already been inwardly collapsed and are disposed proximate the upper surface of base 12, so that the aspects of the overlapping side walls 22, 24 may be focused upon. Each lateral edge of side walls 22, 24 has respectively, at least one upper inwardly extending flange 26, 28 and a recessed wall area 30, 32 disposed below flange 26.

Base end wall 16 includes a recessed base area 34, 36 centrally formed therein. With reference to FIGS. 3–6, as side wall 24 is rotated inwardly, its upper flange 28 rests within recessed base portion 34 (see FIGS. 3–4.) Note that side wall 24 in its fully folded position has an inclined angled orientation, such that lower side wall portion 40 is disposed in a generally parallel relationship with the corresponding angled upper surface 42 of base end portion 16.

Figure 5:
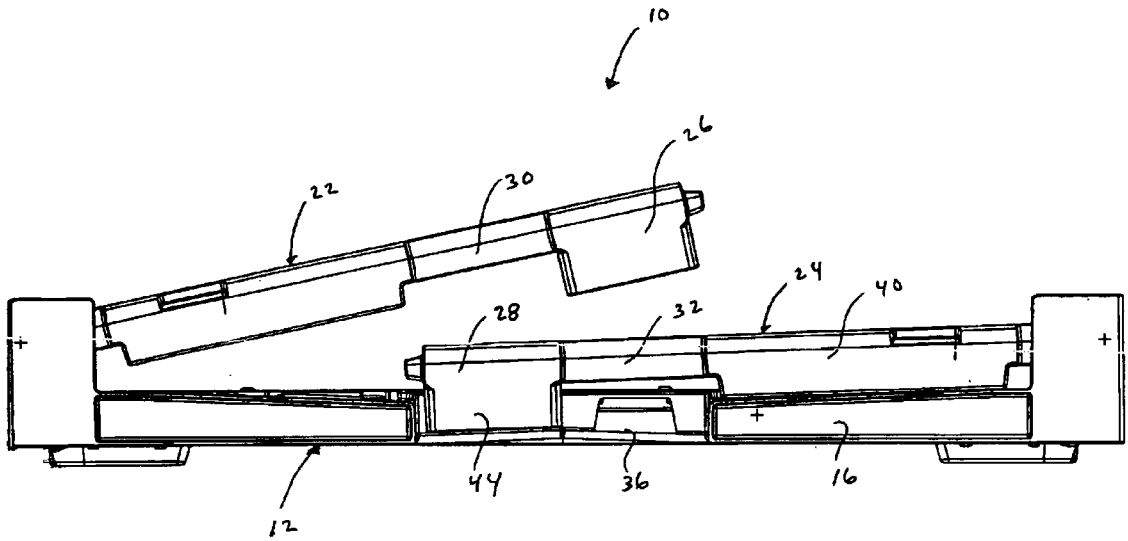
FIG. 5 is a view similar to FIG. 4 but with the second overlapping side wall shown rotated partially inward.
Figure 6:
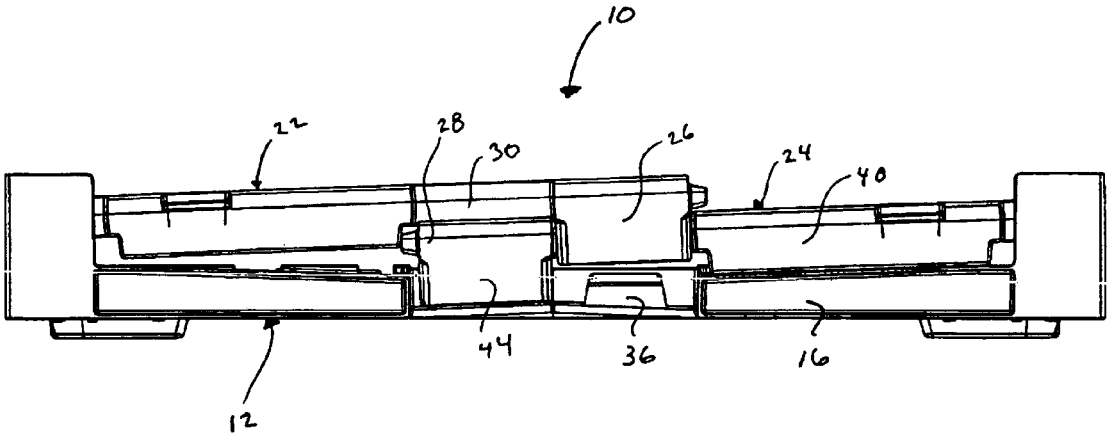
FIG. 6 shows the container in its fully collapsed orientation.

Subsequently, with reference to FIGS. 5–6, end wall 22 is rotated inwardly, such that its upper flange 26 is received within the recessed area 32 of end wall 24. Thus, the walls in the fully collapsed position result in a highly efficient package height for container 10 while remaining symmetrical. With reference to FIG. 6, note that when fully collapsed, side walls 22 and 24 are oriented parallel to each other, although the axis of rotation 48, 50 (hinge axis) of each side wall 22, 24 lie in a common plane generally parallel to base 12 (or in other words axes 48, 50 are disposed at the same height from base 12). Thus, the overlapping walls maybe folded in any sequence.

Figure 7:
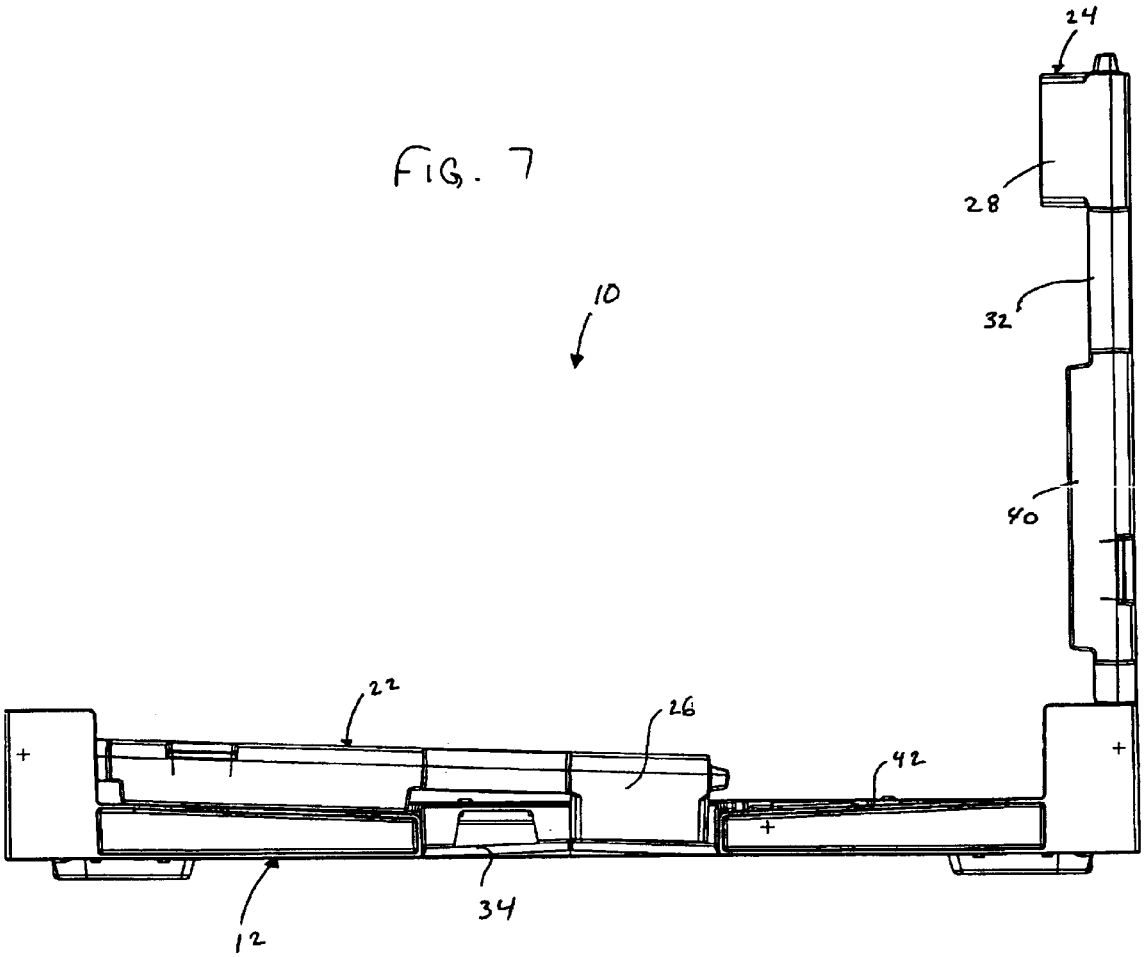
FIG. 7 illustrates a view similar to FIG. 4, but with the opposed overlapping wall folded inwardly first.
Figure 8:
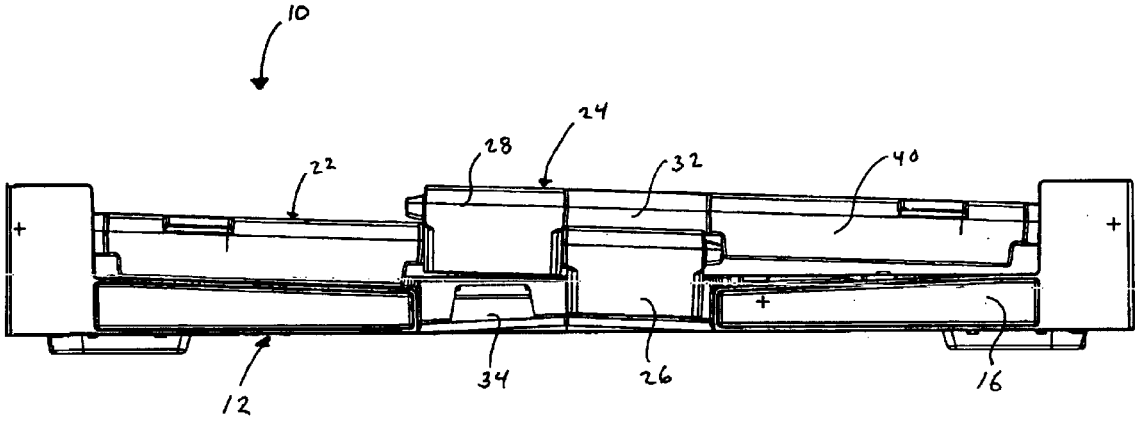
FIG. 8 illustrates a view similar to FIG. 6, but with the walls folded in opposite order.
Figure 9:
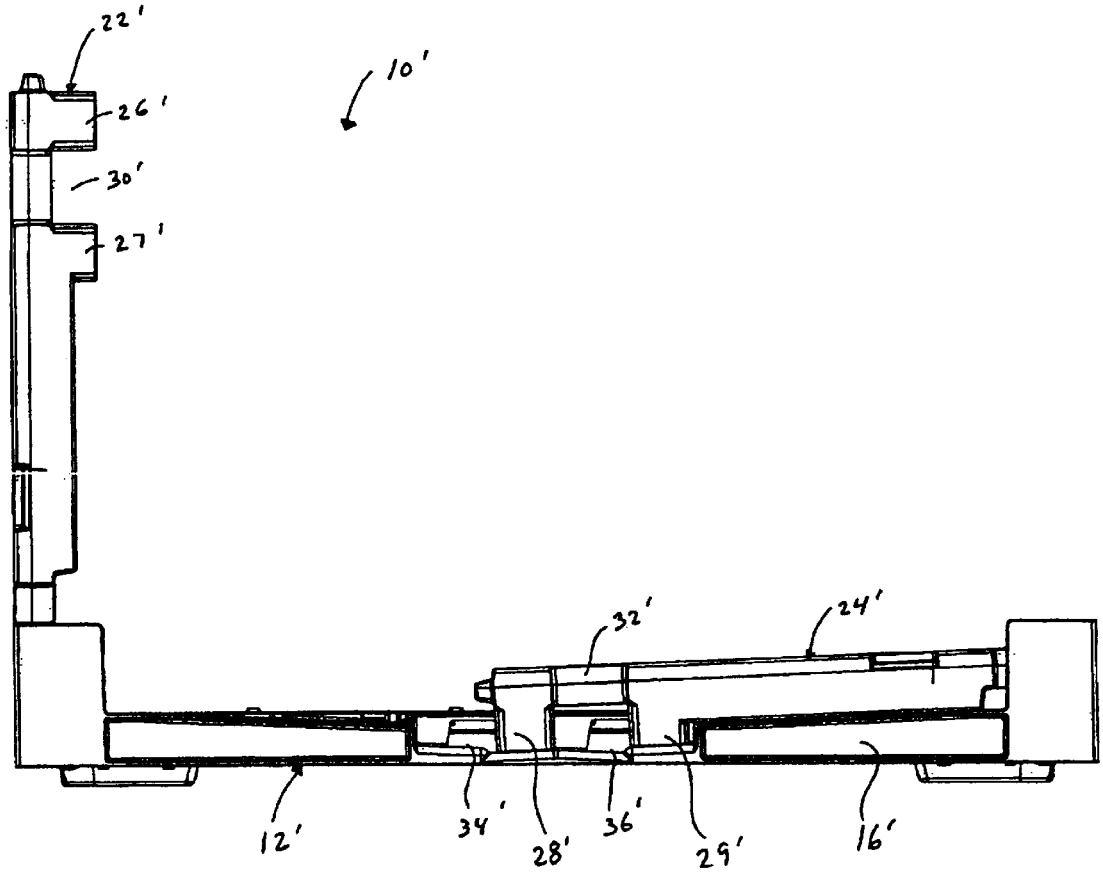
FIG. 9 illustrates a view of the container according to the present invention similar to FIG. 4, but having a plurality of inwardly projecting flanges.

FIGS. 7 through 8 illustrate the non-sequential character of the overlapping walls of container 10. Specifically, FIG. 7 illustrates that end wall 22 may be inwardly folded first such that its upper flange portion 26 is received within recessed base area 36 of base end portion 16. Subsequently, side wall 24 is inwardly folded as shown in FIG. 8 such that the orientation of walls 22, 24 are converse to those shown in FIG. 6. Specifically, upper flange portion 28 of side wall 24 is received within recessed area 30 of side wall 22. As with the sequence shown in FIG. 6, walls 22 and 24 remain parallel with each other in this orientation. Accordingly, the non-sequential folding of the side walls means improved handling and manipulation of container 10 by users. Also, the symmetrical design of container 10 provides for more cost-efficient manufacturing and assembly.

While the teachings according to the present invention have been represented by overlapping walls 22,24, it is fully contemplate that walls 18,20 may overlap instead of or in addition to walls 22,24 without departing from the teachings herein.

Figure 4:
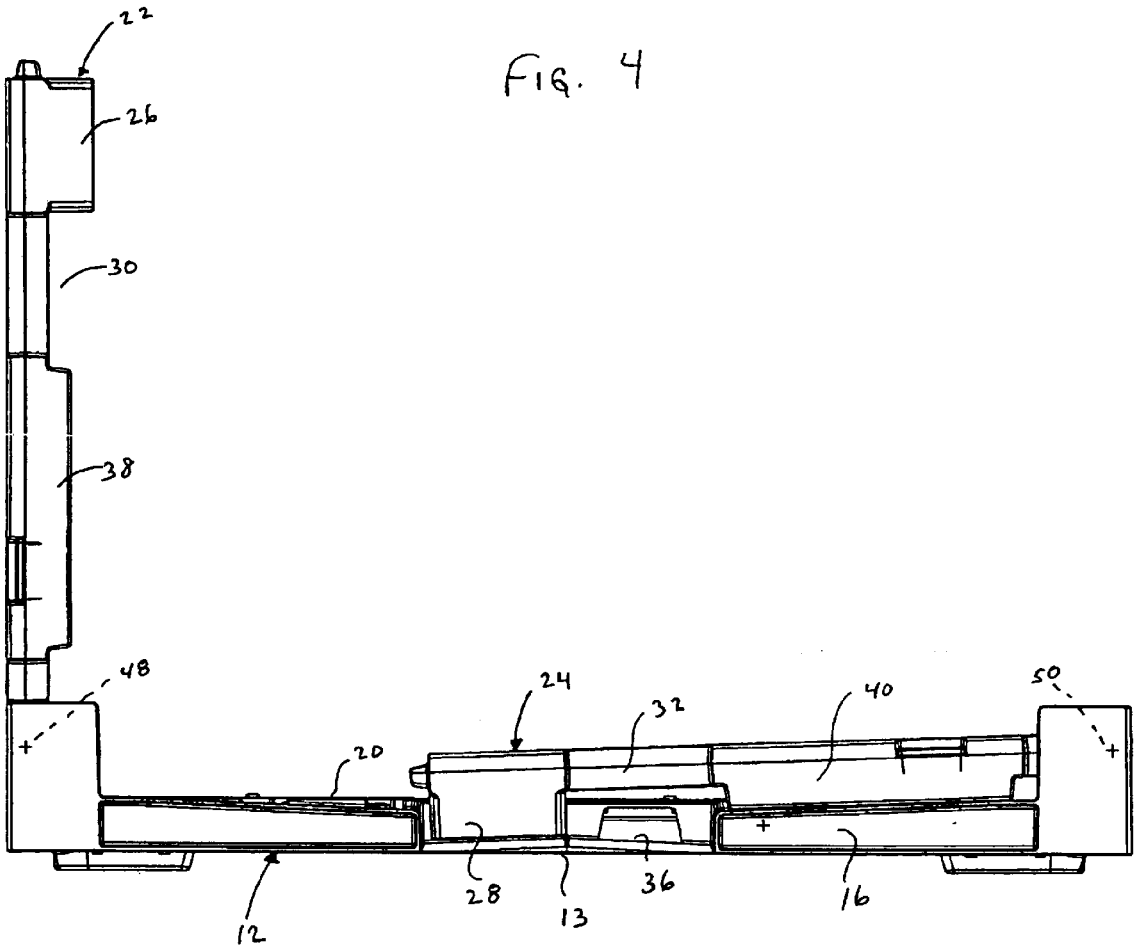
FIG. 4 illustrates a view similar to FIG. 3, but with one of the overlapping side walls rotated fully inward.

FIG. 8 illustrates a view similar to FIG. 4 of container 10', but wherein the lateral edges of sidewalls 22', 24' include a plurality of inwardly projecting flanges. Wall 22' includes flanges 26', 27' with recess 30' therebetween, while wall 24' includes flanges 28', 29' with recess 32' therebetween. Like container 10, walls 22', 24' are able to fold inwardly in a non-sequential manner. For example, sidewall 24' is folded inwardly such that flanges 28', 29' rest within base recesses 34', 36'. Subsequently, wall 22' is folded such that flange 26' of wall 22' rests within wall recess 32' of wall 24', while flange 27' is disposed on the other side of flange 28'. Again, the hinge axis heights of each wall is similar. Accordingly, it is illustrated that the container according may have various overlapping wall features, while still retaining its non-sequential overlapping wall feature.

Figure 10:
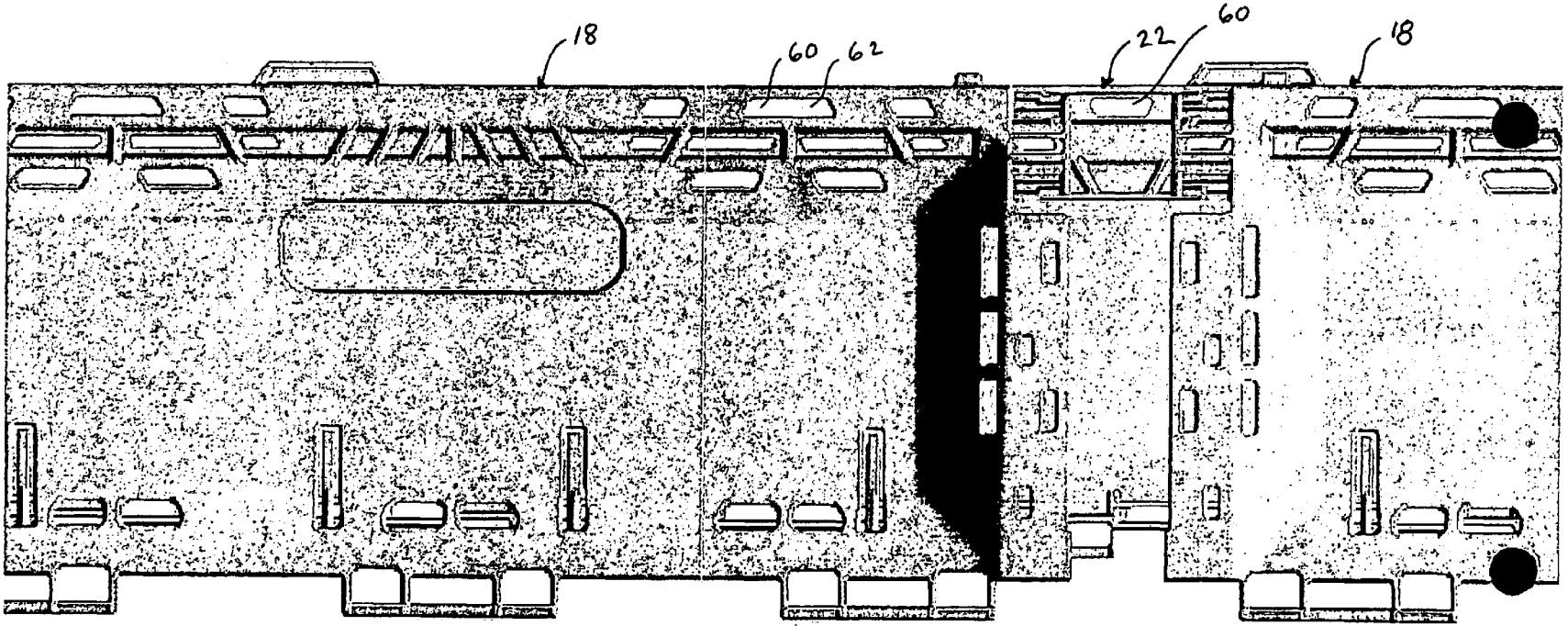
FIG. 10 illustrates an elevational view showing end walls in the foreground, and sidewalls in the background, each having similar repeating patterns of openings to promote air flow through adjacent containers.

Lastly, it is contemplated that when in the upright, assembled orientation, container 10 may be shipped or stored in cross-stacked layered configurations. Should the container have produce stored therein, it is desired to have sufficient airflow among adjacent containers in a layer regardless of their orientation. Thus it is illustrated in FIG. 10 that container 10 includes a similar pattern of openings 60 along its sidewalls and openings 62 along its endwalls that repeat and are easily aligned, such that even if end walls 18 of one crate are proximate side walls 22 of an adjacent crate, the repeating pattern of openings 60, 62 are capable of being aligned to promote the flow of cooled air throughout the layer.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A collapsible container comprising:

a base member having a bottom wall, a pair of first base wall portions and a pair of second base wall portions, the second base wall portions having a recessed base area formed therein;

a pair of first opposed walls pivotably attached to a corresponding one of the second base wall portions and orientable between an upright orientation and an inwardly folded orientation; and a pair of second opposed walls pivotably attached to a corresponding one of the first base wail portions and orientable between an upright orientation and an overlapping folded orientation, each of the second opposed walls generally corresponding in height and each having at least one projection member that connects to an adjacent one of the first opposed walls when the first and second opposed walls are in the upright orientation, each of the at least one projection member arranged to be received within the recessed area of the second base wall portions when in the overlapping folded orientation, and wherein each second opposed wall has a recessed wall area arranged to receive the projection member of an other second opposed wall folded thereon.

2. The collapsible container of claim 1 wherein the pair of second opposed walls are oriented parallel to each other wherein the inwardly folded position.

3. The collapsible container of claim 1 wherein each of the pair of second opposed walls has a pivot axis of equivalent height from the base member.

4. The collapsible container of claim 1 wherein each of the second opposed walls has a pivot axis disposed in a plane which is oriented generally parallel to the base member.

5. A collapsible container comprising:

a base having a pair of base side wall edges and a pair of base end wall edges, the base end wall edges having a recess formed therein;

a pair of opposed end wails pivotably attached to respective end wall edges and orientable between an upstanding orientation and an inwardly collapsed orientation; and a pair of opposed side walls pivotably attached to respective side wail edges along hinge axes having a corresponding height from the base, the pair of opposed side walls orientable between an upstanding position and an overlapping folded position, each side wall having a lateral edge with an upper projecting flange and a recessed area, wherein each upper projecting flange connects to an adjacent one of the end walls when the side walls and end walls are in the upstanding orientation, wherein the side walls may be inwardly foldable in a non-sequential order such that the flange of a first one of the side walls when folded is arranged to be received within the recess of the base end wall edge, while the flange of a second one of the side walls when folded is received within the recessed area of the first one of the side walls, and wherein the side walls are oriented parallel to each other when in the overlapping folded position.

6. The collapsible container of claim 5 wherein the pair of opposed side walls are oriented parallel to each other when in the inwardly folded position.

7. The collapsible container of claim 5 wherein the side walls are generally corresponding in height.

8. The collapsible container of claim 5 wherein each of the side walls has a pivot axis disposed in a plane which is oriented generally parallel to the base.

9. A collapsible container comprising:

a base member having a bottom wall, a pair of first opposed edges and a pair of second opposed edges;

a pair of first opposed walls pivotably connected to the pair of first opposed edges, and orientable between an upright orientation and an inwardly collapsed orientation; and a pair of second opposed walls each pivotably connected to the pair of second opposed edges along corresponding axes of rotation, wherein when oriented in an inwardly collapsed position, the second opposed walls overlap with each other in a parallel orientation, and the corresponding axes of rotation are disposed in a plane generally parallel to the bottom wall of the base member.

10. The collapsible container of claim 9 wherein the second opposed walls are not parallel to the base member when in the inwardly collapsed position.

11. A collapsible container comprising:

a base member having a bottom wall, a pair of first base wall portions and a pair of second base wall portions, the second base wall portions having a recessed base area formed therein;

a pair of opposed first walls each pivotably attached to one of the second base wall portions and orientable between an uptight orientation and an inwardly folded orientation; and a pair of opposed second walls each pivotably attached to one of the first base wall portions and orientable between an upright orientation and an overlapping folded orientation, each of the second walls having at least one projection member for connecting to an adjacent one of the first walls when in the upright orientation, the at least one projection member arranged to be received within the recessed base area of one of the second base wall portions when in the overlapping folded orientation.

12. The collapsible container of claim 11 wherein each second wall has a recessed wall area arranged to receive the projection member of the other second wall folded thereon.

13. The collapsible container of claim 11 wherein the second walls are parallel to one another but are not parallel to the base member when in the overlapping folded orientation.

14. The collapsible container of claim 13 wherein each of the pair of second walls has a pivot axis at an equivalent height from the bottom wall.

15. The collapsible container of claim 11 wherein projection members are formed on lateral edges of the second walls.

16. The collapsible container of claim 15 wherein the second walls each include a recessed area at the lateral edge and wherein the projection member of an upper one of she second walls is received within the recessed area of a lower one of the second walls when the second walls are in the overlapping folded orientation.

17. The collapsible container of claim 11 wherein the second walls in the overlapping folded position may be folded over the first walls in the inwardly folded orientation.

18. The collapsible container of claim 17 wherein each of the pair of second walls has a pivot axis at an equivalent height from the bottom wall.

19. A collapsible container comprising:

a base member having a bottom wall, a pair of first base wall portions and a pair of second base wall portions, the second base wall portions having a recessed base area formed therein;

a pair of first opposed walls pivotably connected to a corresponding one of the second base wall portions and orientable between an upright orientation and an inwardly folded orientation; and a pair of second opposed walls pivotably connected to a corresponding one of the first base wall portions and orientable between an upright orientation and an overlapping folded orientation, the second opposed walls generally corresponding in height, at least a first one of the pair of second opposed walls having a projection member that connects to an adjacent one of the first opposed walls when the first and second opposed walls are in the upright orientation, the projection member arranged to be received within the recessed area of the second base wall portions when in the overlapping folded orientation, and wherein at least a second one of the pair of second opposed walls has a recessed wall area arranged to receive the projection member of an other second opposed wall folded thereon.

* * * * *

UNITED STATES PATENT AND TRADEMARK OFFICE

CERTIFICATE OF CORRECTION

PATENT NO. : 6,863,180 B2
APPLICATION NO. : 10/077543
DATED : March 8, 2005
INVENTOR(S) : Apps et al.

It is certified that error appears in the above-identified patent and that said Letters Patent is hereby corrected as shown below:

Column 5, Line 6, please delete “wail” and insert --wall--.
Column 5, Line 21, please delete “wherein” and insert --when in--.
Column 5, Line 37, please delete “wail” and insert --wall--.

Column 6, Line 19, please delete “uptight” and insert --upright--.
Column 6, Line 46, please delete “she” and insert --the--.

Signed and Sealed this

Fourteenth Day of October, 2008

JON W. DUDAS
*Director of the United States Patent and Trademark Office*